US009631434B2

(12) United States Patent
Davis

(10) Patent No.: US 9,631,434 B2
(45) Date of Patent: Apr. 25, 2017

(54) UNDERREAMER FOR INCREASING A WELLBORE DIAMETER

(71) Applicant: SMITH INTERNATIONAL, INC., Houston, TX (US)

(72) Inventor: Jefferson Allen Davis, Thibodaux, LA (US)

(73) Assignee: SMITH INTERNATIONAL, INC., Houston, TX (US)

( * ) Notice: Subject to any disclaimer, the term of this patent is extended or adjusted under 35 U.S.C. 154(b) by 392 days.

(21) Appl. No.: 14/198,816

(22) Filed: Mar. 6, 2014

(65) Prior Publication Data

US 2014/0262523 A1 Sep. 18, 2014

Related U.S. Application Data

(60) Provisional application No. 61/783,732, filed on Mar. 14, 2013.

(51) Int. Cl.
*E21B 10/32* (2006.01)
*E21B 7/28* (2006.01)
*E21B 10/26* (2006.01)

(52) U.S. Cl.
CPC ..... *E21B 10/322* (2013.01); *E21B 7/28* (2013.01); *E21B 10/26* (2013.01)

(58) Field of Classification Search
CPC . E21B 7/28; E21B 10/40; E21B 10/32; E21B 10/322; E21B 10/26; E21B 10/325; E21B 10/327
See application file for complete search history.

(56) References Cited

U.S. PATENT DOCUMENTS 3,556,233 A * 1/1971 Gilreath ..... E21B 10/322 175/267
6,378,632 B1 4/2002 Dewey et al.
6,732,817 B2 5/2004 Dewey et al.
7,314,099 B2 1/2008 Dewey et al.
7,506,703 B2 3/2009 Campbell et al.
7,594,552 B2 9/2009 Radford et al.
7,658,241 B2 2/2010 Lassoie et al.
7,665,550 B2 2/2010 Rives
(Continued)

OTHER PUBLICATIONS

International Search Report issued in PCT/US2014/159079 mailed on Jun. 24, 2014, 2 pages.
(Continued)

*Primary Examiner* — Nicole Coy

(57) ABSTRACT

An underreamer for increasing a diameter of a wellbore. The underreamer may include a body with first and second cutter blocks coupled to the body. The first cutter block may have a recess formed therein, and the second cutter block may be positioned in the recess. The first and second cutter blocks may move between retracted and expanded states. In the retracted state, the first and second cutter blocks may have an outer diameter less than or equal to an outer diameter of the body. In the expanded state, the first and second cutter blocks may have different outer diameters, with each being greater than the outer diameter of the body. A method may include running the underreamer into a wellbore, expanding the first and second cutter blocks, and moving the underreamer axially in the wellbore to increase the diameter of the wellbore.

20 Claims, 6 Drawing Sheets

(56) References Cited

U.S. PATENT DOCUMENTS

| | | | | |
|---|---|---|---|---|
| 7,770,664 | B2 | 8/2010 | Laird et al. | |
| 7,975,783 | B2 | 7/2011 | Fanuel et al. | |
| 8,028,767 | B2 | 10/2011 | Radford et al. | |
| 8,047,304 | B2 | 11/2011 | Radford | |
| 8,172,009 | B2 | 5/2012 | Hall et al. | |
| 8,215,418 | B2 | 7/2012 | Radford | |
| 8,230,951 | B2 | 7/2012 | Radford et al. | |
| 8,276,690 | B2 | 10/2012 | Lee | |
| 8,281,880 | B2 | 10/2012 | Hall et al. | |
| 8,353,354 | B2 | 1/2013 | Hall et al. | |
| 8,443,875 | B2 | 5/2013 | Lee | |
| 8,453,763 | B2 | 6/2013 | Radford et al. | |
| 8,464,812 | B2 | 6/2013 | Radford et al. | |
| 8,522,646 | B2 | 9/2013 | Laird et al. | |
| 2004/0099444 | A1 | 5/2004 | Chen et al. | |
| 2007/0163808 | A1* | 7/2007 | Campbell | E21B 10/322 175/57 |
| 2008/0115973 | A1 | 5/2008 | Rives | |
| 2010/0175927 | A1 | 7/2010 | Zulak | |
| 2010/0276201 | A1 | 11/2010 | Makkar et al. | |

OTHER PUBLICATIONS

Search Report issued in European Patent Application No. 14774034.4 on Mar. 3, 2016, 3 pages.

* cited by examiner

UNDERREAMER FOR INCREASING A WELLBORE DIAMETER

CROSS-REFERENCE TO RELATED APPLICATIONS

This application claims the benefit of, and priority to, U.S. Patent Application Ser. No. 61/783,732 filed on Mar. 14, 2013 and entitled "UNDERREAMER FOR INCREASING A WELLBORE DIAMETER," which application is expressly incorporated herein by this reference in its entirety.

BACKGROUND

After a wellbore is drilled, an underreamer may be used to enlarge the diameter of the wellbore. In an underreaming operation, the underreamer is run into the wellbore in a retracted state. In the retracted state, cutter assemblies on the underreamer are retracted inward such that a diameter of the underreamer is less than that of the surrounding casing or wellbore. Once the underreamer reaches the desired depth in the wellbore, the underreamer is actuated into an expanded state. In the expanded state, the cutter assemblies move radially-outwardly, and into contact with the wellbore wall. The underreamer and cutter assemblies are then moved longitudinally within the wellbore to increase the diameter of the wellbore over a desired length of the wellbore.

Conventional underreamers have cutter assemblies that are adapted to increase the diameter of the wellbore by up to about 25% from the original (i.e., pilot hole) diameter. If a larger increase in the wellbore diameter is desired, a first underreamer is run in the wellbore. When the operation is complete, the first underreamer is pulled out of the wellbore and a second, larger underreamer is run into the wellbore to further increase the diameter of the wellbore. Running multiple underreamers into a wellbore is a time-consuming process, which leads to an increased number of downhole trips, and a corresponding increase in costs.

SUMMARY

According to some embodiments of the present disclosure, an underreamer is disclosed. The underreamer may include a body with first and second cutter blocks movably coupled thereto. The second cutter block may be positioned in a recess of the first cutter block. The first and second cutter blocks may be movable between a retracted state and an expanded state. In the retracted state, the outer diameter of the first cutter block and the outer diameter of the second cutter block may each be less than or equal to an outer diameter of the body. In the expanded state, the outer diameter of the first cutter block may be greater than the outer diameter of the body, and the outer diameter of the second cutter block may be greater than the outer diameter of the first cutter block.

In another embodiment, an underreamer for increasing a diameter of a wellbore may include a body having an axial bore extending at least partially therethrough. A stop ring may be coupled to the body, and may define at least one slot. A first cutter block may be coupled to the body and movable between a retracted state in which the outer diameter is less than or equal to that of the body, and an expanded state in which the outer diameter is greater than that of the body. A second cutter block may be coupled to the body adjacent the first cutter block. The second cutter block may also move between retracted and expanded states. In the retracted state the second cutter block may have an outer diameter less than or equal to that of the body, while in the expanded state the outer diameter may be greater than that of the first cutter block when in the expanded state. A pin coupled to at least one of the first or second cutter blocks may be positioned in the slot of the stop ring, and move therein when the first or second cutter block moves between expanded and retracted states.

Some embodiments may also relate to a method for increasing a diameter of a wellbore. An example method may include running an underreamer into a wellbore. The underreamer may have a body, multiple first cutter blocks coupled to the body, and multiple second cutter blocks each disposed in a recess of a first cutter block. When the underreamer is run into the wellbore, the first and second cutter blocks may be in a retracted state. The first and second cutter blocks may also be moved to an expanded state in which the outer diameter thereof is greater than that of the body of the underreamer. The expanded diameter of the second cutter blocks may be greater than that of the first cutter blocks. The underreamer may further be moved axially within the wellbore while in the expanded state to increase the diameter of the wellbore with the first and second cutter blocks.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings depict just a few illustrative embodiments. Other embodiments contemplated herein are also within the scope of the present disclosure, the illustrated embodiments are therefore not to be considered limiting of the scope of the present disclosure.

DETAILED DESCRIPTION

Embodiments described herein generally relate to downhole tools. More particularly, some embodiments relate to underreamers for enlarging the diameter of a wellbore. More particularly still, some embodiments of the present disclosure relate to underreamers for so-called high-ratio underreaming and/or stabilizers for centralizing a downhole tool in a wellbore.

Figure 1:
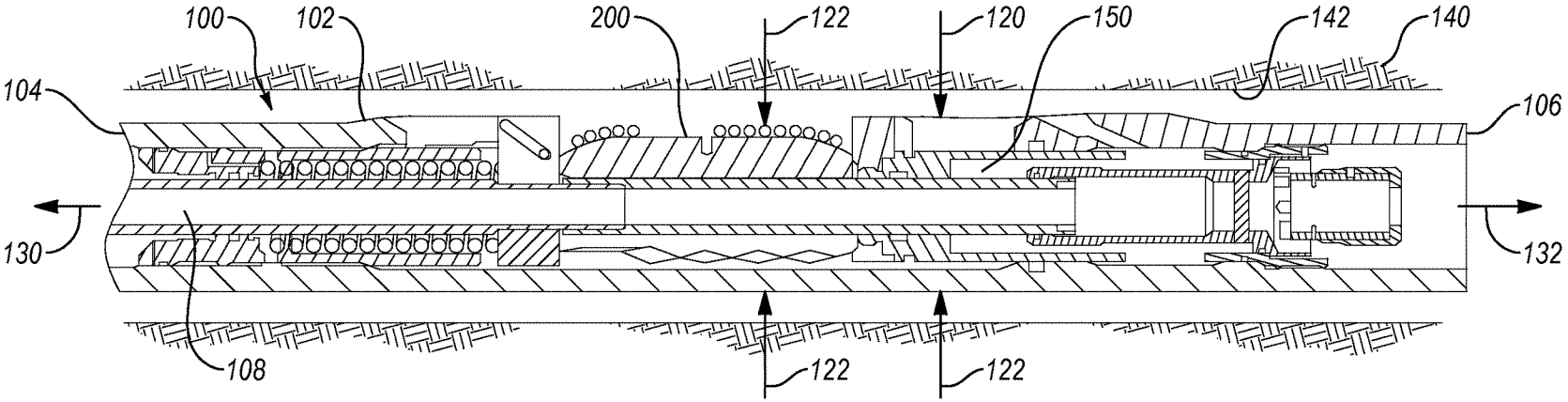
FIG. 1 depicts a cross-sectional view of an illustrative underreamer for increasing a diameter of a wellbore, according to one or more embodiments of the present disclosure.

FIG. 1 depicts a cross-sectional view of an illustrative underreamer 100 for increasing a diameter of a wellbore 140, according to one or more embodiments. The underreamer 100 includes a body 102 having a first or "upper" end 104 and a second or "lower" end 106. An axial bore 108 may also extend partially or completely through the body 102.

One or more cutter assemblies may be coupled to the body 102 in some embodiments of the present disclosure. Although a single cutter assembly 200 may be seen in the cross-sectional view of FIG. 1, one or more additional cutter assemblies may be circumferentially offset around the body 102. For instance, 3 or more cutter assemblies 200 may be circumferentially offset around the body 102 at equal angular offsets (e.g., 120° for 3 cutter assemblies 200) or at unequal angular offsets. In another example, the number of cutter assemblies 200 may range from a low of 1, 2, 3, or 4 to a high of 6, 8, 10, 12, or more. In some embodiments, the multiple cutter assemblies 200 may be axially aligned, but positioned at different circumferential positions around the body 102. In other embodiments, however, one or more of the cutter assemblies 200 may be axially offset (and potentially circumferentially offset) with respect to one or more other cutter assemblies 200.

Figure 2:
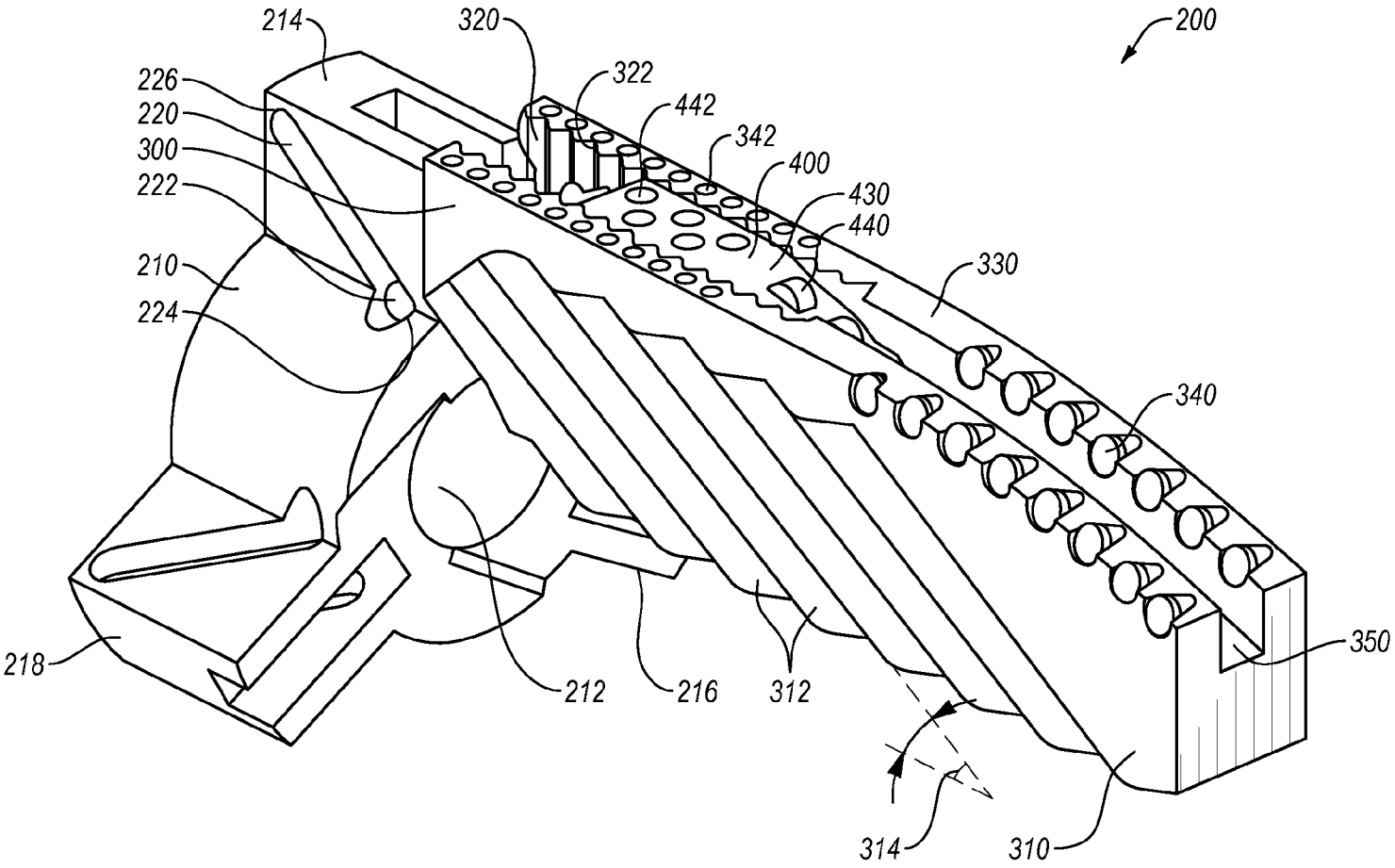
FIG. 2 depicts a perspective view of an illustrative cutter assembly of an underreamer in a retracted state, according to one or more embodiments of the present disclosure.
Figure 3:
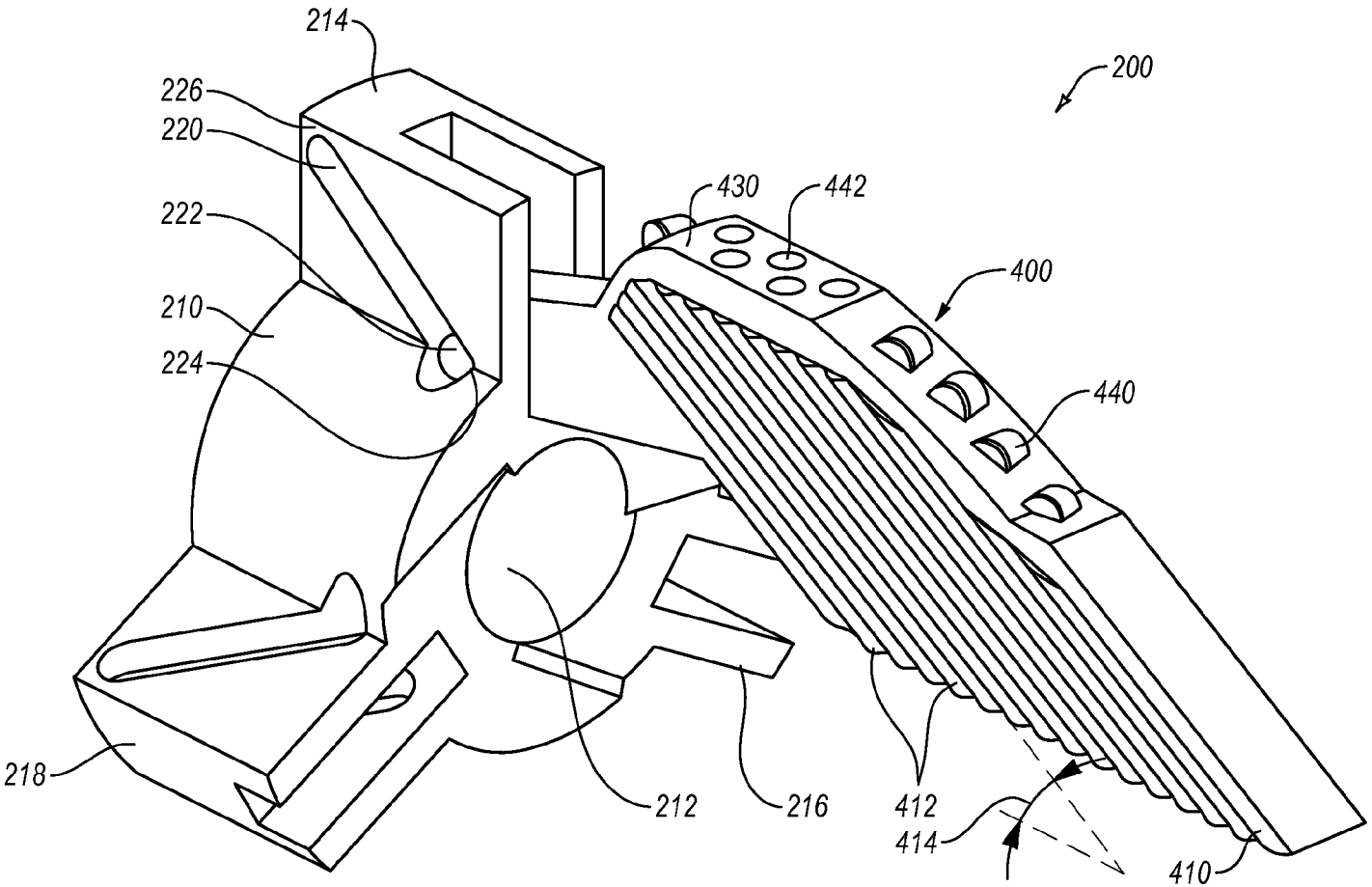
FIG. 3 depicts a perspective view of the cutter assembly of FIG. 3 with a first or outer cutter block removed to expose a second or interior cutter block in a retracted state, according to one or more embodiments of the present disclosure.

FIG. 2 depicts a perspective view of an illustrative cutter assembly 200 of the underreamer 100 in a retracted state, and FIG. 3 depicts a partial perspective view of the cutter assembly 200, in which a first cutter block 300 removed to provide a view of a second cutter block 400, according to one or more embodiments. In some embodiments, the cutter assembly 200 may include a stop ring 210 coupled to the first cutter block 300 and the second cutter block 400.

The stop ring 210 may have an axial bore 212 formed therethrough. In some embodiments, a longitudinal axis through the bore 212 of the stop ring 210 may be parallel to and/or co-axial with a longitudinal axis through the bore 108 of the body 102 of the underreamer 100 of FIG. 1. The stop ring 210 may also include one or more radial extensions (three are shown 214, 216, 218) that are circumferentially offset from one another. Each radial extension 214, 216, 218 may have a slot 220 formed therein for coupling a corresponding second cutter block 400 to the stop ring 210. Accordingly, the stop ring 210 may be coupled to three sets of cutter blocks 300, 400; although a single set of cutter blocks 300, 400 is shown for simplicity.

In accordance with at least some embodiments, a pin 222, roller, or other component may extend from one or more outer side surfaces 410 of the second cutter block 400, and the pin 222 may be at least partially disposed within the slot 220 of the stop ring 210. As the second cutter block 400 moves radially with respect to the stop ring 210, the pin 222 may translate or otherwise move within the slot 220.

Figure 4:
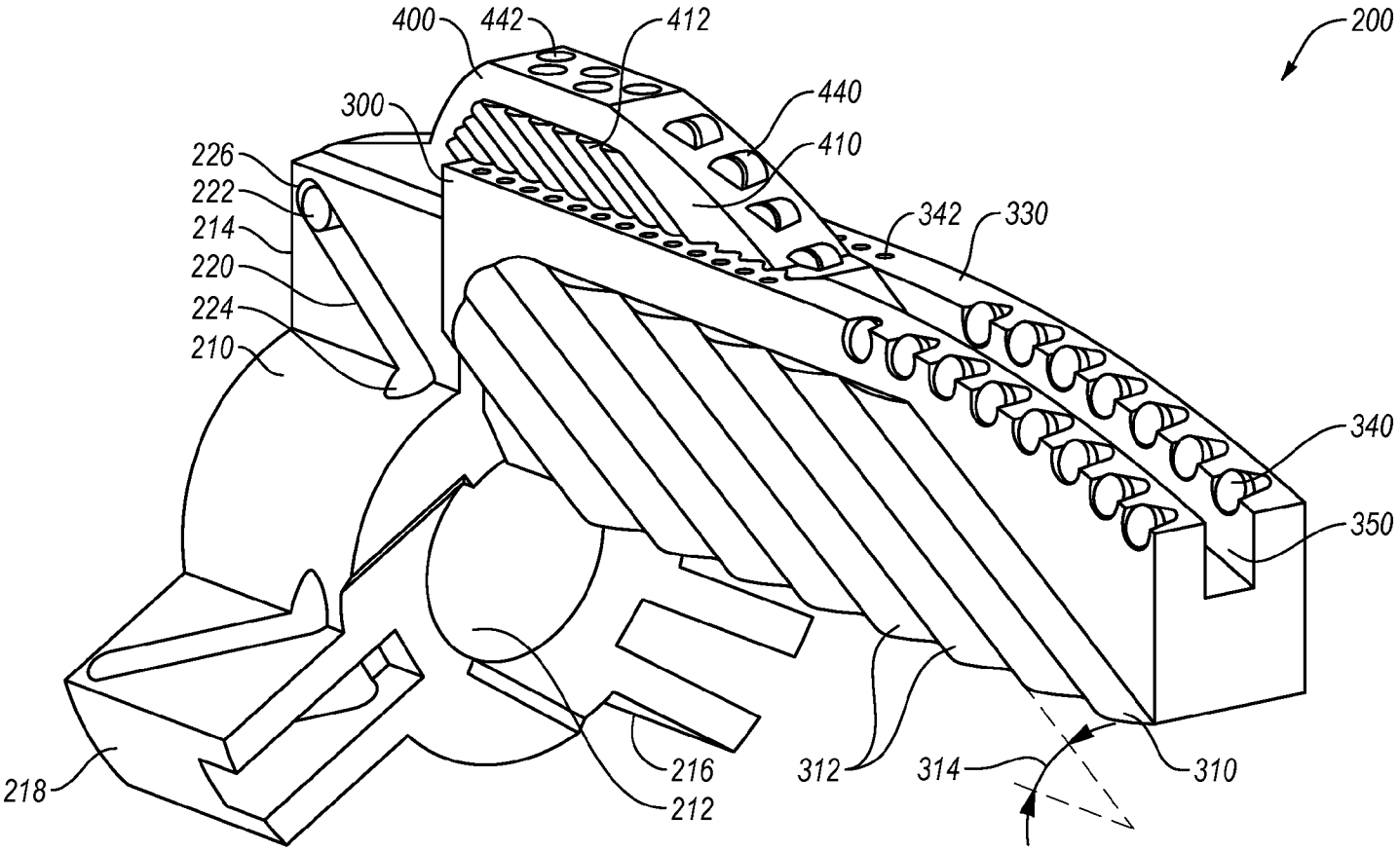
FIG. 4 depicts a perspective view of an illustrative cutter assembly of an underreamer in an expanded state, according to one or more embodiments of the present disclosure.

With continued reference to FIG. 4, the first cutter block 300 may have a plurality of splines 312 disposed or formed on the outer side surfaces 310 thereof. The splines 312 on the first cutter block 300 may be or include offset ridges or protrusions adapted to engage corresponding grooves, notches, or indentations (not shown) in the body 102 of the underreamer 100. In other embodiments, the body 102 may include the ridges or protrusions and the first cutter block 300 may include the grooves, notches, or indentations. The splines 312 on the first cutter block 300 may be oriented at an angle 314 with respect to the longitudinal axis extending through the stop ring 210 and/or the longitudinal axis through the body 102 of the underreamer 100 of FIG. 1. The angle 314 of the splines 312 on the first cutter block 300 relative to the longitudinal axis may range from between about 10° to about 60° in some embodiments. For instance, the angle 314 may range from a low of about 10°, about 15°, about 20°, or about 25° to a high of about 30°, about 35°, about 40°, about 45°, or more. For example, the angle 314 of the splines 312 on the first cutter block 230 may be between about 15° and about 25°, between about 25° and about 35°, between about 27° and about 33°, or between about 30° and about 31°.

The first cutter block 300 may have a plurality of cutting contacts or inserts 340 formed therein or coupled thereto. In some embodiments the cutting inserts 340 may be disposed on and extend from an outer radial surface 330 of the first cutter block 300. In at least one embodiment, the cutting inserts 340 of the first cutter block 300 may include polycrystalline diamond buttons or cutters, cubic boron nitride buttons or cutters, tungsten carbide buttons or cutters, or the like. As shown, the cutting inserts 340 on the first cutter block 300 may be positioned in two axial rows; however, as may be appreciated, the number, size, shape, and orientation of the cutting inserts 340 is illustrative, and other configurations are also contemplated. The cutting inserts 340 on the first cutter block 300 may be configured to cut, grind, or scrape the wall of a wellbore (e.g., wall 142 of the wellbore 140 of FIG. 1) to increase the diameter thereof when the underreamer is in an expanded state, as described in more detail herein.

In the same or other embodiments, the first cutter block 300 may have a plurality of stabilizing pads or inserts 342 disposed on the outer radial surface 330. In at least one embodiment, the stabilizing inserts 342 on the first cutter block 300 may be or include tungsten carbide buttons or inserts, polycrystalline diamond buttons or inserts, cubic boron nitride buttons or inserts, or the like. The stabilizing inserts 342 may be adapted to absorb and reduce vibration between the first cutter block 300 and the wall of the wellbore. In some embodiments, the stabilizing inserts 342 may be omitted or replaced with cutting inserts. Other embodiments contemplate replacing the cutting inserts 340 on the first cutter block 300 with stabilizing inserts.

In some embodiments, the first cutter block 300 may have a channel, void, or recess 350 formed therein. As shown in FIG. 4, the recess 350 may be extend axially along the first cutter block 300 and may be positioned between two axial rows of cutting inserts 340. In accordance with at least some embodiments of the present disclosure, the second cutter block 400 may be at least partially disposed in the recess 350 of the first cutter block 300. The second cutter block 400 may have a plurality of splines 412 (see FIG. 3) formed on the outer side surfaces 410 thereof. The splines 412 on the second cutter block 400 may be or include offset ridges or protrusions adapted to engage corresponding grooves 322 in the inner side surfaces 320 of the first cutter block 300. In other embodiments, the groves may be on the second cutter block 400 and the splines 412 may be located on the first cutter block 300. The splines 412 on the second cutter block 400 and the grooves 322 in the first cutter block 300 may be oriented at an angle 414 with respect to the longitudinal axis extending through the stop ring 210 and/or the longitudinal axis through the body of the underreamer to which the stop ring 210 is coupled. The angle 414 may range from about 10° to about 60° in some embodiments. For instance, the angle 414 may range from low of about 10°, about 15°, about 20°, or about 25° to a high of about 30°, about 35°, about 40°, about 45°, or more. For example, the angle 414 may be between about 15° and about 25°, between about 25° and about 35°, between about 27° and about 33°, or between about 18° and about 22°.

The second cutter block 400 may also include a plurality of cutting contacts or inserts 440 formed thereon or coupled thereto. For instance, a set of cutting inserts 440 may be coupled to the second cutter block 400 and may extend outwardly from an outer radial surface 430 thereof. In at least one embodiment, the cutting inserts 440 on the second cutter block 400 may include cutters, compacts, buttons, or other elements formed from one or more of polycrystalline diamond, tungsten carbide, cubic boron nitride, other materials, or the like. The cutting inserts 440 on the second cutter block 400 may be configured to cut or grind the wall of a wellbore to increase the diameter thereof when an underreamer is in an expanded state, as described in more detail herein.

As shown, the cutting inserts 440 on the second cutter block 400 may be positioned in a single row; however, as will be appreciated by a person having ordinary skill in the art in view of the disclosure herein, the number, size, shape, arrangement, and orientation of the cutting inserts 440 is illustrative, and other configurations are also contemplated. For instance, the cutting inserts 440 may be arranged in multiple axial rows, may have constant or variable spacing therebetween, or may be otherwise arranged.

In the same or other embodiments, the second cutter block 400 may have a plurality of stabilizing pads or inserts 442 on the outer radial surface 430 or another portion thereof. In at least one embodiment, the stabilizing inserts 442 on the second cutter block 400 may be or include inserts or buttons formed from tungsten carbide, polycrystalline diamond, cubic boron nitride, or the like. The stabilizing inserts 442 may be adapted to absorb and reduce vibration between the second cutter block 400 and the wall 142 of the wellbore 140. In other embodiments, the stabilizing inserts 442 may be omitted and/or replaced with cutting inserts. Similarly, some embodiments contemplate omitting the cutting inserts 440 and/or replacing them with stabilizing inserts.

The cutter assembly 200 shown in FIGS. 1-3 is illustrated in an inactive or retracted state. When the cutter assembly 200 is in the retracted state, the first and second cutter blocks 300, 400 may be positioned to define a first diameter 122 of the underreamer 100 (see FIG. 1). More particularly, the outer radial surfaces 330 of the first cutter blocks 300 and the outer radial surfaces 430 of the second cutter blocks 400 may be positioned at or within the first diameter 122. The first diameter 122 may be less than or equal to the outer diameter 120 of the stop ring 210 and/or the body 102. In addition, when the cutter assembly 200 is in the retracted state, the pin 222 may be positioned proximate a first end portion 224 of the slot 220 in the stop ring 210. As shown in FIG. 3, the first end portion 224 of the slot 220 may be radially nearer the axial bore 212 than a second end portion 226 of the slot 220. Thus, when the cutter assembly 200 is in the retracted state at the first diameter 122, the cutter assembly 200 may be spaced apart from the surrounding casing (not shown) and/or wall 142 of the wellbore 140.

Figure 5:
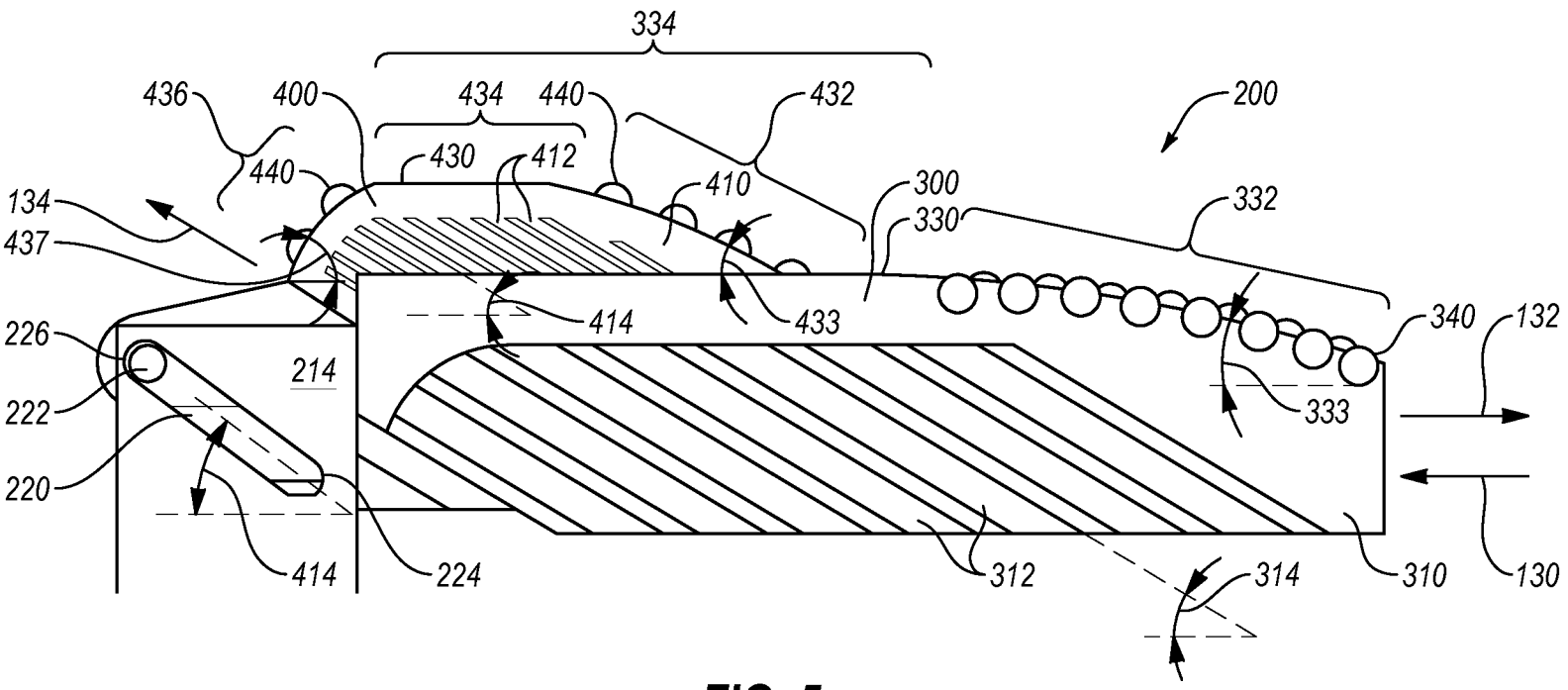
FIG. 5 depicts a side view of the cutter assembly of the underreamer in FIG. 4 the expanded state, according to one or more embodiments of the present disclosure.

FIG. 4 depicts a perspective view of the cutter assembly 200 of an underreamer (e.g., underreamer 100 of FIG. 1) in an expanded state, and FIG. 5 depicts a side view of the cutter assembly 200 of the underreamer 100 in the expanded state, according to one or more embodiments of the present disclosure. When an axial force is exerted on the first cutter block 300 (e.g., in a direction 130 toward the first end 104 of the body 102 as seen in FIG. 1), the engagement of the splines 312 on the first cutter block 300 and the grooves in the body (e.g., body 102) may cause the first cutter block 300 to move axially as well as radially outwardly in a direction 134, which may be toward the first end 104 of the body 102 as shown in FIG. 1. The combined radial and axial movement may generally correspond to movement at the angle 314 relative to the longitudinal axis of the stop ring 210.

The movement of the first cutter block 300 may exert a force on the second cutter block 400 in an axial or other direction (e.g., direction 130 of FIG. 1). When this force is exerted on the second cutter block 400, the engagement of the splines 412 on the second cutter block 400 and the grooves 322 in the first cutter block 300 may cause the second cutter block 400 to move both axially (e.g., toward the first end 104 of the body 102 of FIG. 1) and radially outwardly (e.g., in the direction 134) at the angle 414. In some embodiments, the angle 414 and the angle 314 are each between about 15° and about 45°, although such range is merely illustrative, and the angle 314 and/or angle 414 may be varied in other embodiments. Thus, while the angles 314 and 414 may be about equal in some embodiments, in other embodiments they may be different. For instance, in a particular illustrative embodiment, the angle 314 may be greater than the angle 414. As an example, the angle 314 may be between about 25° and about 35° while the angle 414 may be between about 15° and about 25°. In another embodiment the angle 314 may be less than the angle 414. For instance, the angle 314 may be between about 15° and about 25° while the angle 414 may be between about 25° and about 35°. In the latter embodiment, the angle 414 may be greater/larger than angle 314, and the first and second cutter blocks 300, 400 may both move in the same axial and radial directions. The exact angle measurement and the difference between the angles 314, 414 may determine the rate of the movement and the actual distance traveled for the cutter blocks 300, 400.

As will be appreciated in view of the disclosure herein, the angles 314, 414 of the splines 312, 412 may allow axially directed forces to move the first and second cutter blocks 300, 400 in axial and radial directions, and even to allow the second cutter block 400 to move axially and/or radially within the first cutter block 300. As the second cutter block 400 moves (e.g., in the direction 134), the pin 222 coupled thereto may slide from a position proximate the first end portion 224 of the slot 220 in the stop ring 210 toward the second end portion 226 of the slot 220 in the stop ring 210. The slot 220 may be oriented at the angle 414 to facilitate movement of the pin 222, although the slot 220 may be otherwise oriented or contoured. When the pin 222 contacts the second end portion 226 of the slot 220, further movement of the first and second cutter blocks 300, 400 in the direction 134 may be restricted and potentially prevented. The pin 222 may thus move as the second cutter block 400 slides axially and radially within the first cutter block 300, and may thus be used for restricting a sliding motion, which motion may also be non-pivoting in some embodiments of the present disclosure.

With continued reference to FIG. 5, a first portion 332 of the outer radial surface 330 of the first cutter block 300 may be curved or oriented at an angle 333 with respect to the longitudinal axis through the stop ring 210 and/or the body of a corresponding underreamer. The angle 333 may range from about 2° to about 60° in some embodiments. For instance, the angle 33 may range from a low of about 2°, about 4°, about 6°, or about 8° to a high of about 10°, about 15°, about 20°, about 25°, about 45°, or more. For example, the angle 333 may be between about 2° and about 10°, between about 10° and about 20°, or between about 5° and about 15°. The cutting inserts 340 may be disposed on the first portion 332 of the first cutter block 300. In some embodiments, the first portion 332 may be proximate the outer radial edge of the first cutter block 300 (e.g., distal relative to the stop ring 210).

The first portion 332 of the outer radial surface 330 of the first cutter block 300 may transition into a second portion 334, which in the illustrated embodiment is nearer the stop ring 210. In at least some embodiments, the second portion 334 of the outer radial surface 330 of the first cutter block 300 may be generally parallel with the longitudinal axis through the stop ring 210 and/or the body of the underreamer or downhole tool. Optionally, the stabilizing inserts 342 may be disposed on the second portion 334. In other embodiments, the first portion 332 and/or second portion 334 may be arranged in other manners. For instance, the first portion 332 and/or second portion 334 may be oriented at a different angle, may be undulating, or may otherwise be contoured or configured.

In some embodiments, the second cutter block 400 may include multiple portions. For instance, a first portion 432 of the outer radial surface 430 of the second cutter block 400 may be near the outer or distal edge of the second cutter block 400 and may be curved or oriented at an angle 433 with respect to the longitudinal axis through the stop ring 210 and/or the body 102. In some embodiments, the angle 433 may range from about 2° to about 75°. For instance, the angle 433 may range from a low of about 5°, about 10°, about 15°, or about 20° to a high of about 25°, about 30°, about 35°, about 40°, or more. For example, the angle 433 may be between about 15° and about 25°, between about 25° and about 35°, or between about 15° and about 35°. A first plurality of the cutting inserts 440 may be disposed on the first portion 432.

The first portion 432 of the outer radial surface 430 of the second cutter block 400 may transition into a second portion 434, which in FIG. 5 is closer to the stop ring 210 than is the first portion 432. The second portion 434 of the outer radial surface 430 of the second cutter block 400 may be generally parallel with the longitudinal axis through the stop ring 210 and/or a body of an underreamer or downhole tool. The stabilizing inserts 442 may be disposed on the second portion 434.

The second portion 434 of the outer radial surface 430 of the second cutter block 400 may transition into a third portion 436, which in FIG. 5 is still closer to the stop ring 210. The third portion 436 may be curved or oriented at an angle 437 with respect to the longitudinal axis through the stop ring 210 and/or the body 102. The angle 437 may range from about 2° to about 90° in some embodiments. For instance, the angle 437 may range from a low of about 10°, about 20°, about 30°, or about 40° to a high of about 50°, about 60°, about 70°, about 80°, or more. For example, the angle 437 may be between about 30° and about 50°, between about 50° and about 70°, or between about 30° and about 70°. A second plurality of the cutting inserts 440 may be disposed on the third portion 436. In other embodiments, the first, second, and third portions 432, 434, 436 may be otherwise arranged, contoured, or configured. For instance, the portions 432, 434, 436 may extend at angles other than those described, or may be undulating or otherwise contoured.

In some embodiments, the cutting inserts 340, 440 may be cylindrical, however, the cutting inserts 340, 440 may have other shapes as well. By way of illustration, the cutting inserts 340, 440 may include semi-round top cutters, conical top cutters, frustoconical top cutters, lobed cutters, buttons, or other shaped cutters. In some embodiments, some of the cutting inserts 340, 440 may have different shapes or be oriented in different directions relative to other cutting inserts 340, 440. As an example, the four cutting inserts 440 shown in FIG. 5 on the first portion 432 of the outer radial surface 430 may be cylindrical and oriented with their longitudinal axes about parallel to the outer surface of the second cutter block 400 (e.g. extending across a width of the second cutter block 400). In other embodiments, the cutting inserts 440 may have their longitudinal axes perpendicular or otherwise inclined relative to the outer surface of the second cutter block 400. In some embodiments, some of the cutting inserts 440 on the first portion 432 may be oriented differently than others. For instance, the two cutting inserts 440 furthest from the second portion 434 may extend perpendicularly relative to the first portion 432 of the outer surface 430, while the cutting inserts 440 nearest the second portion 434 may extend parallel to the first portion 432 of the outer surface 430. In some embodiments, cutting inserts 340, 440 that extend perpendicularly relative to the corresponding portion of the outer surface 330, 430 of the cutter blocks 300, 400 may have conical, frustoconical, semi-round, lobed or other tops or tips, while the cutting inserts 440 parallel to the outer surface are cylindrical.

Figure 6:
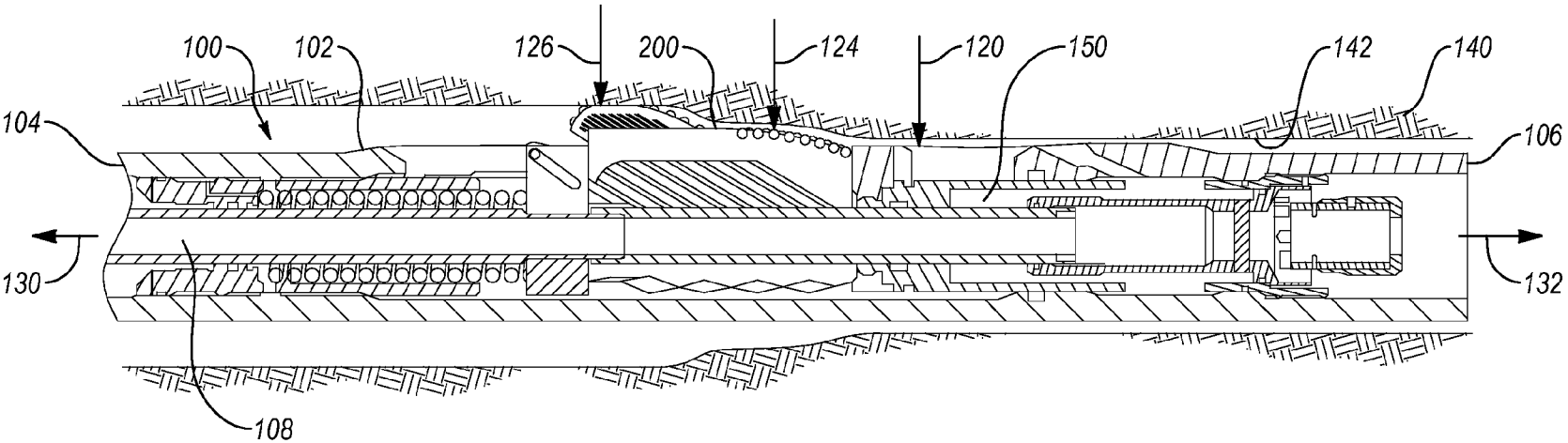
FIG. 6 depicts a cross-sectional view of an underreamer in the expanded state, according to one or more embodiments of the present disclosure.

FIG. 6 depicts a cross-sectional view of the underreamer 100 of FIG. 1 in an expanded state, according to one or more embodiments of the present disclosure. With reference to the embodiments shown in FIGS. 4-6, when the cutter assembly 200 is in the expanded state, the first cutter block 300 may be positioned at a second diameter 124, while the second cutter block 400 may be positioned at a third diameter 126. The second diameter 124 may be greater than the first diameter 122 (see FIG. 1) and/or the diameter 120 of the body 102, and the third diameter 126 may be greater than the second diameter 124. A ratio of the second diameter 124 to the first diameter 122 and/or the diameter 120 of the body 102 may be between about 1.05:1 and about 1.30:1, between about 1.05:1 and about 1.20:1, or between about 1.05:1 and about 1.15:1. A ratio of the third diameter 126 to the first diameter 122 and/or the diameter 120 of the body 102 may be between about 1.10:1 and about 1.60:1, between about 1.10:1 and about 1.40:1, between about 1.20:1 and about 1.40:1, or between about 1.25:1 and about 1.35:1. In addition, when the cutter assembly 200 is in the expanded state, the pin 222 may be positioned proximate a second end portion 226 of the slot 220 in the stop ring 210, or nearer the second end portion 226 of the slot 220 than when the cutter assembly 200 is in the retracted state.

When the cutter assembly 200 is in the expanded state, the first and/or second cutter blocks 300, 400 may be in contact with the wall 142 of the wellbore 140 and adapted to increase the diameter thereof. In at least one embodiment, the cutter assembly 200 may be adapted to increase the diameter of the wall 142 of the wellbore 140 by about 20%, about 25%, about 30%, about 35%, about 40%, or more. For example, the cutter assembly 200 may be adapted to increase the diameter of the wall 142 of the wellbore 140 by between about 5% and about 50%. For instance, the cutter assembly 200 may be used to increase the diameter of the wall 142 between about 20% and about 30%, between about 25% and about 35%, or between about 30% and about 40%.

Referring now to FIGS. 1-6, in operation, the underreamer 100 may be run into the wellbore 140 by a work string (not shown) coupled to the first end 104 thereof. The underreamer 100 may be in the retracted, run-in state as it is run into the wellbore 140, as shown in FIGS. 1-3.

When the underreamer 100 is positioned at the desired depth in the wellbore 140, pressure may be applied from the surface, through the work string, and to the bore 108 of the underreamer 100. The pressure may be applied by, for instance, flowing fluid through the drill work string and/or underreamer 100, increasing fluid flow through the work string and/or underreamer 100, using a flow restrictor (e.g., a drop ball) to increase fluid pressure, or the like. The pressure in the bore 108 may cause a chamber 150 disposed between the cutter assembly 200 and the second end 106 of the body 102 to become pressurized. The pressure in the chamber 150 may exert a force on the cutter assembly 200 in the direction 130 (see FIGS. 5 and 6) toward the first end 104 of the body 102. The force may further cause the first cutter blocks 300 to move in the direction 134 (see FIGS. 5 and 6) until the outer radial surfaces 330 of the first cutter blocks 300 are at the second diameter 124.

The pressure and/or movement of each first cutter block 300 may also exert a force on the second cutter blocks 400 in the direction 134. The force may cause the second cutter blocks 400 to move in the direction 134 until the outer radial surfaces 440 of the second cutter blocks 400 are at the third diameter 126. As discussed herein, when the outer radial surfaces 330 of the first cutter blocks 300 are at the second diameter 124, and the outer radial surfaces 430 of the second cutter blocks 400 are at the third diameter 126, the cutter assembly 200 may be in a fully expanded state, as shown in FIGS. 4-6. As discussed herein, the number of first and second cutter blocks 300, 400 may vary in some embodiments of the present disclosure. FIG. 2, for instance, illustrates an embodiment in which a stop ring 210 is usable with three sets of first and second cutter blocks 300, 400; however, in other embodiments more or fewer than three sets of first and second cutter blocks 300, 400 may be used with the underreamer 100.

When the underreamer 100 is in the expanded state, the underreamer 100 may move in a "downhole" direction 132 (see FIGS. 5 and 6) in the wellbore 140 away from the surface. As the underreamer 100 moves in the downhole direction 132, the cutting inserts 340 on the first cutter blocks 300 may cut or grind the wall 142 of the wellbore 140 to increase the diameter thereof to the second diameter 126. As the underreamer 100 continues to move in the downhole direction 132, the cutting inserts 440 on the first portions 432 of the second cutter blocks 400 may cut or grind the wall 142 of the wellbore 140 to increase the diameter thereof from the second diameter 124 to the third diameter 126.

The underreamer 100 may also move in an "uphole" direction 130 (see FIGS. 5 and 6) in the wellbore 140 toward the surface. As the underreamer 100 moves in the uphole direction 130, the cutting inserts 440 on the third portions 136 of the second cutter blocks 400 may cut or grind the wall 142 of the wellbore 140 to increase the diameter thereof to the third diameter 126.

The stabilizing inserts 342 on the second portions 334 of the first cutter blocks 300 and/or the stabilizing inserts 442 on the second portion 434 of the second cutter block 400 may be in contact with the wall 142 of the wellbore 140. The stabilizing inserts 342, 442 may absorb and/or reduce vibration caused by the first and second cutter blocks 300, 400 cutting or grinding the wall 142 of the wellbore 140. In other embodiments, the arrangement of the first and second cutter blocks 300, 400 may be reversed. In such an embodiment, for instance, the splines 312 may be oriented in an opposite direction and the first and/or second cutter blocks 300, 400 may be flipped such that the cutting inserts 340 cut or grind the wall 142 of the wellbore 140 when moved in an uphole direction, and the cutting inserts 440 cut or grind the wall 142 of the wellbore 140 when moved in a downhole direction.

When the underreamer 100 has increased the diameter of the desired portion of the wellbore 140, the pressure in the bore 108 and the chamber 150 may be reduced. As the pressure in the chamber 150 decreases, the force acting on the cutter assembly 200 in the direction 130 may also decrease. This may cause the first and second cutter blocks 300, 400 to retract into the cutter assembly 200 such that the cutter assembly 200 returns to the retracted state and has the first diameter 122. When the cutter assembly 200 is in the retracted state, the underreamer 100 may be run further into the wellbore 140 in the downhole direction 132 or pulled in the uphole direction 130 and potentially out of the wellbore 140.

As an additional illustration, some embodiments of the present disclosure may be used in a casing while drilling environment in which a pilot hole or wellbore 140 is drilled, and which underreaming is performed to enlarge the wellbore 140 to a size sufficient for the casing. The wellbore 140 may, for example, have a diameter of about 6.75 inches. In operation, the underreamer 100 may be run into the wellbore 140 in a retracted state, and the outer diameter 120 of the body 102 and the first diameter 122 of the underreamer 100 (see FIG. 1) may be less than or equal to 6.75 inches to allow insertion of the underreamer 100. Once at a desired location within the pilot hole or wellbore 140, the cutter assembly 200 may be expanded. The use of dual cutter blocks 300, 400 may allow enlargement of the wellbore 140. For instance, the first cutter block 300 to expand to a second diameter 124 of about 8.25 inches. The second cutter block 400 may, however, expand to a third diameter 126 of about 9.875 inches. The first cutter block 300 may therefore be used to expand the diameter of the wellbore 140 by about 1.5 inches and produce a wellbore 140 that has a diameter about 22% larger than that of the original wellbore 140 (i.e., has a ratio of about 1.22:1 relative to the original diameter). The second cutter block 400 may expand the diameter of the wellbore 140 by an additional 1.625 inches, such that the total diameter of the wellbore 140 may then be about 46% larger than that of the original wellbore 140 (i.e., has a ratio of about 1.46:1 relative to the original diameter). This embodiment is, however, merely illustrative. In other embodiments, for instance, the original diameter of the wellbore 140 may be greater or less than 6.75 inches, and/or the cutter blocks 300, 400 may enlarge the wellbore 140 by more or less than 3.125 inches or more or less than 46%. In still other embodiments, an underreamer 100 of the present disclosure may be used for applications other than casing while drilling. For instance, the underreamer 100 may be used in both openhole and cased hole operations. In openhole operations, the underreamer 100 may expand the wellbore even in the absence of casing while drilling equipment and tools. In a cased hole operation, the underreamer 100 may be used as a casing cutter, mill, or other tool (e.g., to cut casing for a slot recovery operation, to cut casing for abandonment operations, etc.)

While embodiments herein have been described with primary reference to downhole tools, such embodiments are provided solely to illustrate one environment in which aspects of the present disclosure may be used. In other embodiments, expandable tools, reamers, underreamers, or systems, assemblies, or methods related thereto as discussed herein, or which would be appreciated in view of the disclosure herein, may be used in other applications, including in automotive, aquatic, aerospace, hydroelectric, or other industries.

In the description and in the claims, the terms "including" and "comprising" are used in an open-ended fashion, and thus should be interpreted to mean "including, but not limited to . . . ." Further, the terms "axial" and "axially" generally mean along or parallel to a central or longitudinal axis, while the terms "radial" and "radially" generally mean perpendicular to a longitudinal axis.

In the description herein, various relational terms are provided to facilitate an understanding of various aspects of some embodiments of the present disclosure in relation to the provided drawings. Relational terms such as "bottom," "below," "top," "above," "back," "front," "left", "right", "rear", "forward", "up", "down", "horizontal", "vertical", "clockwise", "counterclockwise," "upper", "lower", and the like, may be used to describe various components, including their operation and/or illustrated position relative to one or more other components. Relational terms do not indicate a particular orientation for each embodiment within the scope of the description or claims. For example, a component of a bottomhole assembly that is "below" another component may be more downhole while within a vertical wellbore, but may have a different orientation during assembly, when removed from the wellbore, or in a deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Relational terms may also be used to differentiate between similar components; however, descriptions may also refer to certain components or elements using designations such as "first," "second," "third," and the like. Such language is also provided merely for differentiation purposes, and is not intended limit a component to a singular designation. As such, a component referenced in the specification as the "first" component may or may not be the same component referenced in the claims as a "first" component.

Furthermore, to the extent the description or claims refer to "an additional" or "other" element, feature, aspect, component, or the like, it does not preclude there being a single element, or more than one, of the additional element. Where the claims or description refer to "a" or "an" element, such reference is not be construed that there is just one of that element, but is instead to be inclusive of other components and understood as "one or more" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," "integral with," or "in connection with via one or more intermediate elements or members."

Certain embodiments and features may have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges may appear in one or more claims below. Any numerical value is "about" or "approximately" the indicated value, and take into account experimental error and variations that would be expected by a person having ordinary skill in the art.

In the claims, means-plus-function clauses are intended to cover the structures described herein as performing the recited function, including both structural equivalents and equivalent structures. Thus, although a nail and a screw may not be structural equivalents in that a nail employs a cylindrical surface to couple wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An underreamer, comprising:

a body;

a first cutter block movably coupled to the body and having a recess therein, the first cutter block being movable between a retracted state and an expanded state, wherein in the retracted state of the first cutter block an outer diameter of the first cutter block is less than or equal to an outer diameter of the body, and in the expanded state of the first cutter block the outer diameter of the first cutter block is greater than the outer diameter of the body, wherein the first cutter block has an outer radial surface, a first portion of the outer radial surface being oriented at an angle between about 5° and about 15° with respect to a longitudinal axis of the body, the first portion having one or more cutting inserts disposed thereon; and a second cutter block positioned within the recess of the first cutter block and movably coupled to the body, the first cutter block, or both, the second cutter block being movable between a retracted state and an expanded state, wherein in the retracted state of the second cutter block an outer diameter of the second cutter block is less than or equal to the outer diameter of the body, and in the expanded state of the second cutter block the outer diameter of the second cutter block is greater than the outer diameter of the first cutter block in the expanded state of the first cutter block.

2. The underreamer of claim 1, the first cutter block comprising a plurality of splines oriented at an angle between about 25° and about 35° with respect to a longitudinal axis of the body.

3. The underreamer of claim 1, the second cutter block comprising a plurality of splines oriented at an angle between about 25° and about 35° with respect to a longitudinal axis of the body.

4. The underreamer of claim 3, the splines being positioned on an outer side surface of the second cutter block and engaged with a plurality of grooves formed on an inner side surface of the first cutter block.

5. The underreamer of claim 1, further comprising a stop ring within the body and coupled to the second cutter block by a pin that moves within a slot in the stop ring when the second cutter block moves from the retracted state of the second cutter block to the expanded state of the second cutter block.

6. The underreamer of claim 1, a second portion of the outer radial surface of the first cutter block being substantially parallel to the longitudinal axis of the body.

7. The underreamer of claim 6, the second portion of the outer radial surface of the first cutter block having a one or more stabilizing inserts disposed thereon.

8. The underreamer of claim 1, the second cutter block having an outer radial surface, a first portion of which is oriented at an angle between about 15° and about 35° with respect to a longitudinal axis of the body.

9. The underreamer of claim 8, the first portion of the outer radial surface of the second cutter block having one or more cutting inserts disposed thereon.

10. The underreamer of claim 9, a second portion of the outer radial surface of the second cutter block being substantially parallel to the longitudinal axis of the body, the second portion of the outer radial surface of the second cutter block having one or more stabilizing inserts disposed thereon.

11. The underreamer of claim 10, a third portion of the outer radial surface of the second cutter block being oriented at an angle between about 30° and about 70° with respect to the longitudinal axis of the body.

12. The underreamer of claim 11, the third portion of the outer radial surface of the second cutter block having one or more cutting inserts disposed thereon.

13. An underreamer for increasing a diameter of a wellbore, comprising:

a body having an axial bore extending at least partially therethrough;

a stop ring coupled to the body, the stop ring defining at least one slot;

a first cutter block coupled to the body, the first cutter block being movable between a retracted state in which an outer diameter of the first cutter block is less than or equal to an outer diameter of the body and an expanded state in which the outer diameter of the first cutting block is greater than the outer diameter of the body;

a second cutter block coupled to the body and positioned adjacent the first cutter block, the second cutter block being movable between a retracted state in which an outer diameter of the second cutter block is less than or equal to the outer diameter of the body and an expanded state in which the outer diameter of the second cutting block is greater than the outer diameter of the first cutter block in the expanded state of the first cutter block; and a pin coupled to at least one of the first cutter block or the second cutter block, the pin being at least partially disposed within the slot of the stop ring, and the pin being movable within the slot when at least one of the first cutter block moves between the retracted and expanded states of the first cutter block or the second cutter block moves between the retracted and expanded states of the second cutter block.

14. The underreamer of claim 13, the slot being oriented at an angle between about 25° and about 35° with respect to a longitudinal axis of the body.

15. The underreamer of claim 13, the pin being positioned proximate a first end of the slot when the second cutter block is in the retracted state and proximate a second end of the slot when the second cutter block is in the expanded state.

16. The underreamer of claim 13, the first cutter block being configured to move from the retracted state of the first cutter block to the expanded state of the second cutter block simultaneously with the second cutter block moving from the retracted state of the second cutter block to the expanded state of the second cutter block.

17. The underreamer of claim 13, the second cutter block being positioned at least partially within a recess of the first cutter block when the second cutter block is in the retracted state of the second cutter block and the first cutter block is in the retracted state of the first cutter block.

18. A method for increasing a diameter of a wellbore, comprising:

running an underreamer into a wellbore, the underreamer including:

a body;

a plurality of first cutter blocks coupled to the body in a retracted state within an opening in the body, the plurality of first cutter blocks including an outer radial surface having a plurality of cutting elements coupled thereto; and a plurality of second cutter blocks, each of the plurality of second cutter blocks being in a retracted state and disposed within a recess of one of the plurality of first cutter blocks, the plurality of second cutter blocks including an outer radial surface having a plurality of cutting elements coupled thereto;

moving the plurality of first cutter blocks of the underreamer from the retracted state of the first cutter blocks to an expanded state of the first cutter blocks, an outer diameter of the plurality of first cutter blocks in the expanded state of the first cutter blocks being greater than an outer diameter of the body;

moving the plurality of second cutter blocks of the underreamer from the retracted state of the second cutter blocks to an expanded state of the second cutter blocks, an outer diameter of the plurality of second cutter blocks in the expanded state of the second cutter blocks being greater than the outer diameter of the body and the outer diameter of the plurality of first cutter blocks in the expanded state of the first cutter blocks; and moving the underreamer axially within the wellbore while the plurality of first cutter blocks are in the expanded state of the first cutter blocks and the plurality of second cutter blocks are in the expanded state of the second cutter blocks, thereby increasing the diameter of the wellbore with the plurality of cutting elements of the plurality of first cutter blocks and the plurality of cutting elements of the plurality of second cutter blocks.

19. The method of claim 18, wherein moving the plurality of first and second cutter blocks occurs about simultaneously, the plurality of first and second cutter blocks further being moved at different angles, each of which are between about 25° and about 35° with respect to a longitudinal axis of the body.

20. The method of claim 18, wherein moving the plurality of first and second cutter blocks occurs in response to increasing a pressure of a fluid in a bore of the body.

* * * * *